US008418343B2

(12) United States Patent
Dunleavy et al.

(10) Patent No.: US 8,418,343 B2
(45) Date of Patent: Apr. 16, 2013

(54) METHOD FOR PRODUCING A METALLIC PART COMPRISING INNER REINFORCEMENTS CONSISTING OF CERAMIC FIBERS

(75) Inventors: Patrick Dunleavy, Palaiseau (FR); Richard Masson, Buc (FR)

(73) Assignee: Messier-Bugatti-Dowty, Velizy-Villacoublay (FR)

( * ) Notice: Subject to any disclaimer, the term of this patent is extended or adjusted under 35 U.S.C. 154(b) by 269 days.

(21) Appl. No.: 13/002,580

(22) PCT Filed: Jul. 3, 2009

(86) PCT No.: PCT/FR2009/051306

§ 371 (c)(1),
(2), (4) Date: Jan. 4, 2011

(87) PCT Pub. No.: WO2010/001068

PCT Pub. Date: Jan. 7, 2010

(65) Prior Publication Data

US 2011/0099791 A1 May 5, 2011

(30) Foreign Application Priority Data

Jul. 4, 2008 (FR) ..... 08 54589

(51) Int. Cl.
*B23P 11/02* (2006.01)

(52) U.S. Cl.
USPC ..... 29/447; 29/889.71; 29/419.1; 29/446; 228/234.1

(58) Field of Classification Search ..... 29/889.2, 29/889.21, 889.22, 889.23, 889.7, 889.71, 29/419.1, 446, 447; 228/165, 180.5, 234.1, 228/246, 174, 193, 245
See application file for complete search history.

(56) References Cited

U.S. PATENT DOCUMENTS 4,314,007 A * 2/1982 Gessinger ..... 428/614
4,441,874 A * 4/1984 Kumar et al. ..... 425/78
(Continued)

FOREIGN PATENT DOCUMENTS

EP 1 726 677 11/2006
FR 2925895 A1 * 7/2009
FR 2925896 A1 * 7/2009

OTHER PUBLICATIONS

International Search Report issued Jan. 27, 2010 in PCT/FR09/051306 filed Jul. 3, 2009.

(Continued)

*Primary Examiner* — Essama Omgba
(74) *Attorney, Agent, or Firm* — Oblon, Spivak, McClelland, Maier & Neustadt, L.L.P.

(57) ABSTRACT

A method for producing a metallic part including inner reinforcements of ceramic fibers, according to which: at least one recess for an insert is machined in a metallic body having an upper surface; at least one insert of ceramic fibers in a metallic matrix is arranged in the recess; the insert is covered with a cover; the gap around the insert is placed under a vacuum and hermetically sealed; the entire metallic body with the cover is treated by hot isostatic compaction; and the treated assembly is machined to produce the part. The insert is rectilinear, and the recess for the insert in the metallic body forms a rectilinear groove, the cover being dimensioned so as to be able to placed on the insert in the recess after having been shrunk by cooling and to establish a tight fit in the groove by dilation such as to close the space.

9 Claims, 2 Drawing Sheets

U.S. PATENT DOCUMENTS

| | | | | |
|---|---|---|---|---|
| 4,782,992 | A * | 11/1988 | Doble | 228/190 |
| 4,900,599 | A * | 2/1990 | Doble | 428/64.1 |
| 4,919,594 | A * | 4/1990 | Wright et al. | 416/230 |
| 5,184,769 | A * | 2/1993 | Moracz et al. | 228/121 |
| 5,222,296 | A * | 6/1993 | Doorbar et al. | 29/889.21 |
| 5,305,520 | A * | 4/1994 | Doorbar et al. | 29/889.21 |
| 5,337,940 | A * | 8/1994 | Woods et al. | 228/190 |
| 5,427,304 | A * | 6/1995 | Woods et al. | 228/190 |
| 5,745,994 | A * | 5/1998 | Honnorat | 29/889.2 |
| 5,946,801 | A * | 9/1999 | Twigg et al. | 29/889.71 |
| 6,247,638 | B1 * | 6/2001 | Ress, Jr. | 228/193 |
| 6,658,715 | B1 * | 12/2003 | Podesta' | 29/419.1 |
| 6,698,645 | B1 * | 3/2004 | Buchberger et al. | 228/173.1 |
| 6,786,389 | B2 * | 9/2004 | Pursell | 228/165 |
| 7,316,066 | B2 * | 1/2008 | Twigg | 29/889.71 |
| 7,325,306 | B2 * | 2/2008 | Twigg | 29/889.71 |
| 7,343,677 | B2 * | 3/2008 | Twigg | 29/889.71 |
| 7,507,935 | B2 * | 3/2009 | Franchet et al. | 219/121.64 |
| 7,511,248 | B2 * | 3/2009 | Franchet et al. | 219/121.64 |
| 7,516,548 | B2 * | 4/2009 | Twigg | 29/889.71 |
| 7,543,379 | B2 * | 6/2009 | Twigg | 29/889.71 |
| 7,726,023 | B2 * | 6/2010 | Pursell | 29/889.23 |
| 7,814,695 | B1 * | 10/2010 | Keeney et al. | 42/75.01 |
| 7,842,375 | B2 * | 11/2010 | Vetters | 428/172 |
| 8,065,799 | B2 * | 11/2011 | Fabre | 29/889.2 |
| 2003/0017053 | A1 * | 1/2003 | Baldwin et al. | 416/229 A |
| 2003/0029904 | A1 * | 2/2003 | Pursell | 228/127 |
| 2005/0166386 | A1 * | 8/2005 | Twigg | 29/458 |
| 2007/0020134 | A1 | 1/2007 | Pursell | |
| 2007/0051455 | A1 | 3/2007 | Franchet et al. | |
| 2007/0271784 | A1 * | 11/2007 | Fabre | 29/889.2 |
| 2010/0291339 | A1 | 11/2010 | Dunleavy et al. | |
| 2011/0005060 | A1 * | 1/2011 | Masson et al. | 29/592 |
| 2011/0005061 | A1 | 1/2011 | Masson et al. | |
| 2011/0027119 | A1 | 2/2011 | Masson | |
| 2011/0053872 | A1 | 3/2011 | Zhu et al. | |
| 2011/0099791 | A1 * | 5/2011 | Dunleavy et al. | 29/428 |
| 2011/0107579 | A1 * | 5/2011 | Dunleavy et al. | 29/419.1 |
| 2012/0234431 | A1 * | 9/2012 | Franchet et al. | 140/93 R |
| 2012/0255961 | A1 * | 10/2012 | Masson et al. | 220/639 |

OTHER PUBLICATIONS

U.S. Appl. No. 13/378,815, filed Dec. 16, 2011, Dunleavy, et al.
U.S. Appl. No. 12/670,767, filed Jul. 7, 2010, Dunleavy, et al.
U.S. Appl. No. 13/002,514, filed Jan. 4, 2011, Dunleavy, et al.
U.S. Appl. No. 12/997,785, filed Dec. 13, 2010, Dunleavy, et al.

* cited by examiner

METHOD FOR PRODUCING A METALLIC PART COMPRISING INNER REINFORCEMENTS CONSISTING OF CERAMIC FIBERS

FIELD OF THE INVENTION

The present invention relates to the manufacture of metal parts having internal reinforcements formed from ceramic fibres and obtained by the incorporation of a fibrous insert into a metal matrix.

BACKGROUND

For the purpose of reducing the weight of metal parts while giving them greater strength, especially in tension or in compression, it is known to incorporate ceramic fibres thereinto. For example, these are silicon carbide (SiC) fibres which have a tensile strength and a compressive strength that are substantially greater than that of a metal such as titanium.

The manufacture of these parts involves the prior formation of inserts from metal-coated ceramic filaments. They are also referred to as CMM fibres or coated filaments. The metal gives, in particular, the elasticity and flexibility necessary for handling them.

A known process for manufacturing such reinforced parts comprises the production of a winding of coated filaments around a mandrel. The winding is then introduced into a main metal body or container in which a slot forming the housing for the insert has been machined beforehand. The depth of the slot is greater than the height of the winding. A cover is placed on the container and welded to its periphery. The cover has a tenon having a shape complementary to that of the slot, and its height is adapted to that of the winding placed in the slot so as to fill the slot. Next, a hot isostatic pressing step is carried out, during which the cover is deformed and the winding is compressed by the tenon. The surface of the container along the edge of the slot is inclined so as to form a corner face for ensuring progressive deformation of the cover during the pressing phase.

The hot isostatic pressing technique consists in placing the part in an enclosure subjected to high pressure, of the order of 1000 bar, and also to high temperature, of the order of 1000° C., for a few hours.

During this treatment, the metal sheaths of the coated filaments are welded together and to the walls of the slot by diffusion welding, to form a dense assembly composed of a metal alloy within which the ceramic fibres extend. The part obtained is then machined to the desired shape.

The process serves for the manufacture of axisymmetric aeronautical parts, such as rotor disks or blisks (integrally bladed disks), but also non-axisymmetric parts such as connecting rods, shafts, actuator bodies and casings.

It is difficult to machine the slot in the main body, especially because of the small joining radii in the bottom of the slot between the surface of the bottom and the side walls. Such a small joining radius is necessary in order to house the insert with as small a clearance as possible, the insert having a rectangular cross section and being formed from small-radius filaments. The machining of the corresponding tenon in the cover is not easy either, because of the non-open-ended corners and because it is necessary to have a shape perfectly matching the slot.

The Applicant has developed a process for manufacturing parts of elongate shape that incorporate an insert with straight portions contributing to the transmission of the unidirectional tensile and/or compressive forces. This process is described in Patent Application FR 07/05453 of 26 Jul. 2007. The Applicant has also developed a process for manufacturing a straight insert. This process consists in producing an insert blank in the form of a winding, in compacting said blank in a container by hot isostatic pressing and then in machining the straight inserts in the compacted container. Such a process is described in patent application FR 07/05454 of 26 Jul. 2007.

However, when the parts to be produced are not axisymmetric, but are of oblong shape, with an oval shape or else of a shape with straight portions, precise adjustment over long lengths is difficult to achieve. This is even more difficult for inserts formed from very rigid coated filaments, because of the ceramic fibres that require the formation of housings in which they fit perfectly. The cover must be assembled perfectly in the slot so as not to let the fibres escape.

Instead of manufacturing the insert separately and then transferring it to the slot of the main body, Patent FR 2 886 290 in the name of SNECMA proposes, according to one embodiment, to produce the winding directly on the main body. Instead of a slot, two shoulders are provided in the body. The first one has a bearing surface for the direct winding of a coated filament. This surface is parallel to the winding direction. When the winding has been completed, the slot is reconstituted by placing a part on the main body which has a shape complementary to that of a second shoulder forming a step in relation to the first shoulder. The cover with the tenon is then positioned on the insert that has just been wound and the assembly undergoes a compacting operation. The manufacturing problem is only partly solved by this solution, since the assembly operation remains complicated.

Patent Application FR 07/09171 in the name of the Applicant specifies that the housing for the insert in the metal body has the form of a notch of L-shaped cross section, the cover having an internal notch of L-shaped cross section and of shape complementary to that of the metal body with said insert. Furthermore, the cover is shaped on the outside so that the compressive forces are exerted perpendicular to the faces of the notch.

Thus, the current manufacturing techniques make it possible to create metal parts that include one or more reinforcements made of metal-matrix composites from a winding of coated fibres and a container—a body and a cover. These structures are very effective but have a high manufacturing cost. In particular, the machining of the main body of the container with its cover represents a large fraction of the total cost of the parts.

SUMMARY

The objective of embodiments of the invention is to improve the process for manufacturing parts of elongate shape for the purpose of simplifying the steps of the production operation and of reducing the costs.

This objective is achieved according to the invention by a process for manufacturing a metal part reinforced with ceramic fibres, in which:

- at least one housing for an insert is machined in a metal body having an upper face;
- at least one insert formed from metal-coated ceramic fibres is placed in the housing;
- the insert is covered with a cover;
- a vacuum is created in the interstitial space around the insert and said space is hermetically sealed under vacuum;
- the assembly, namely the metal body with the cover, is treated by hot isostatic pressure; and
- said treated assembly is machined in order to obtain said part.

The process is characterized in that the insert is straight, and the housing for the insert in the metal body has a straight slot of corresponding shape, the cover being designed so as to allow it to be fitted onto the insert with a clearance in the housing after having been contracted by being cooled and to exert a tight fit by expansion in the slot so as to hermetically close off said space.

For example, the cover is cooled by means of a liquefied gas, such as liquid nitrogen, reducing its dimensions.

Sealing is achieved by ensuring that there is tight contact between the cover and the walls of the slot, thereby simplifying the shape of the slot.

According to one embodiment, the slot comprises a first housing portion for the insert and at least one second portion extending the first portion, the cover being block-shaped and comprising a central branch covering the insert and an extension of shape corresponding to the second portion of the slot. The cover thus forms an easily producible metal block of simple geometry.

Preferably, the cover comprises a progressive deformation zone between the central branch and the extension. This progressive deformation zone prevents the cover from cracking during the pressing step.

The insert has a polygonal, especially rectangular, oval or circular, cross section.

Preferably, the insert is formed from metal-coated fibres assembled into a bundle, thereby reducing the preparatory operations.

The solution of the invention has a particular advantage when fitting two inserts of elongate shape which are placed along two parallel or non-parallel straight branches. According to the prior art, to obtain two longitudinal internal reinforcements, an insert of annular shape with two straight branches connected together by two circularly arcuate portions is produced beforehand. The housing is then machined according to the precise shape of the insert. Adjusting the shape of the housing to that of the insert has proved to be a very tricky and expensive operation. Thus, eliminating the fillets simplifies both the machining and the fitting, without sacrificing the strength of the final part since the fibres work essentially along their longitudinal direction in the central section of the part.

DETAILED DESCRIPTION OF THE EMBODIMENTS

Figure 1:
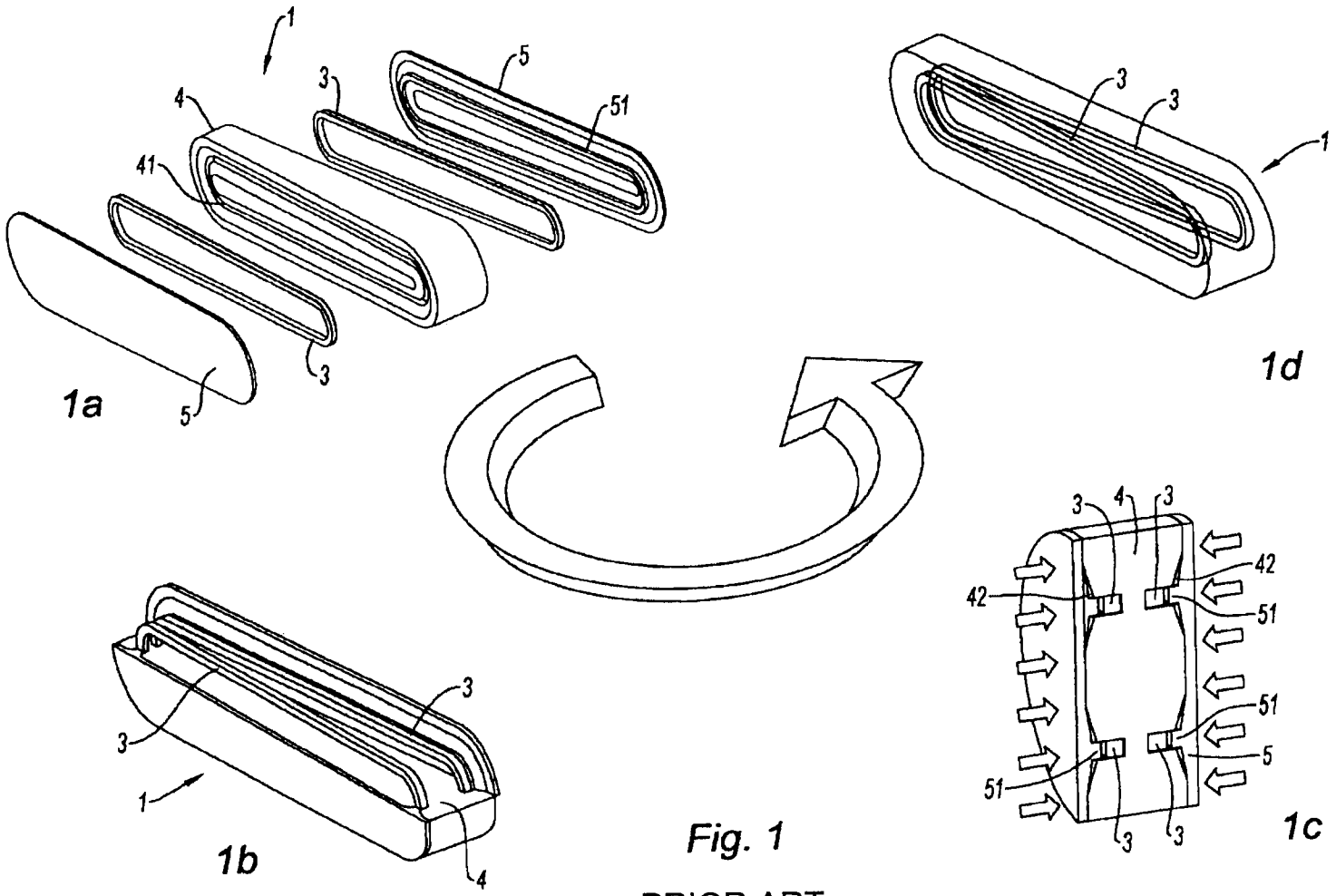
Fig. 1 PRIOR ART
FIG. 1 shows the various steps 1*a*, 1*b*, 1*c*, 1*d* in the manufacture of an elongate part according to the known prior art of the present Applicant.

One non-limiting embodiment of the invention will now be described in greater detail with reference to the above-appended drawing. FIG. 1, taken from Patent Application FR 07/05453, shows a container 1 with a main body 4 of elongate shape, intended to form a connecting rod, for example for a landing gear. A slot 41 is machined in each of the two faces of the body 4. This slot serves to house an insert 3, which comprises two straight portions, which may or may not be parallel to each other, joined at the ends by a circularly arcuate portion. The inserts are of the type having ceramic fibres coated with a metal, such as titanium. The slots and the inserts have complementary shapes so that the insert is fitted into the slot with no clearance or with a minimal clearance. Two covers 5 are provided with a projecting portion, which forms a tenon 51, and cover the faces of the body 4. The tenon presses on the insert housed in the slot and fills the latter. The cover 5 is welded to the body 4, for example by electron beam welding, a vacuum being created inside the container. This assembly has the function of preventing the fibres, which have a very small diameter, of around 0.25 mm, from being able to move or escape during the hot isostatic pressing. The container, shown in FIG. 1*b*, is partly removed so as to show the inserts. The container is then placed in an enclosure so as to undergo a hot isostatic pressing treatment. The cross section of the container in FIG. 1*c* shows that the edges 42 of the slot 41 are chamfered so as to leave a clearance with the portion of the cover 5 adjacent to the tenon 51.

During the hot isostatic pressing operation, the pressure is exerted in the direction perpendicular to the surface of the cover, causing the covers to collapse. The heat and pressure, at around 1000° C. and 1000 bar, allow the matrix metal to occupy the gaps between the coated filaments making up the insert. The volume of the insert decreases by about 23%. The tenon is thus moved downwards and the clearance on either side of the tenon is absorbed. At the end of the procedure, the metal has fused and the container compacted. The part is thus reinforced by the filaments embedded in the mass of metal. FIG. 1*d* shows the part blank obtained with two inserts visible as if the part were transparent.

Figure 2:
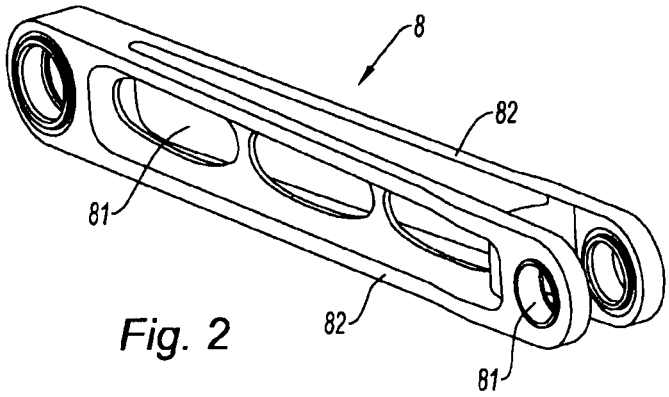
FIG. 2 shows an example of a part obtained after machining a container incorporating inserts.

The blank is then machined so as to obtain the part 8 shown in FIG. 2. This part 8 has holes 81 between the branches 82. The ceramic fibres are incorporated into the branches 82, which ensure that the tensile and compressive forces are transmitted. The inserts used are of annular shape but, as described in Patent Application FR 07/05454, they may be formed from straight elements, in the form of bars. In the latter case, the straight elements are incorporated into the container after they have been compacted beforehand.

The solution of the invention enables such parts to be obtained more economically.

Figure 3:
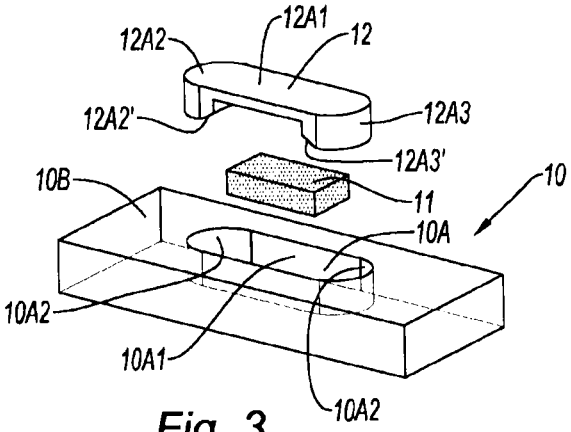
FIG. 3 shows in perspective a metal body with a machined slot in accordance with the invention and the fitting of the insert and the block-shaped cover.
Figure 4:
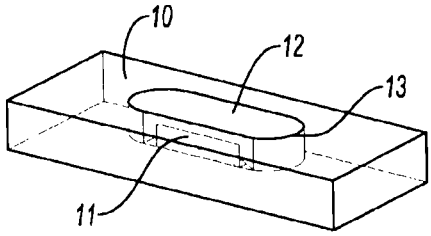
FIG. 4 shows in perspective, and as if transparent, the insert and the block-shaped cover in place in the metal block, the assembly being ready for the not isostatic pressing treatment.

FIG. 3 shows a metal body 10 of elongate shape with, in relation to this figure, an upper face 10B. A straight slot 10A, the bottom of which is flat and the walls of which are perpendicular to the bottom, is machined. The joining surface between the bottom and the walls has a small radius of curvature so as to allow the insert to be fitted with as small as possible a clearance. The slot has a central portion 10A1 and two end portions 10A2 and 10A3 in the longitudinal extension thereof. The end parts are rounded. The slot serves as a housing for a straight insert 11, formed from an assembly of coated ceramic fibres, the inserts having a length 1 smaller than or equal to the length of the central portion 10A1 of the slot. The insert forms a bundle fitting into the central portion 10A1 of the slot.

A cover 12 covers the insert 11 placed in its housing. The cover 12 has the same shape and the same dimensions, to within a clearance, enabling it to be fitted into the slot, when it is seen from above, as the slot 10A. It forms a block with a central portion 12A1 covering the insert and two end portions 12A2 and 12A3 in the longitudinal extension of the central portion on either side of the latter. The thickness of the two end portions corresponds to the thickness of the central portion plus that of the insert placed in the slot and is slightly greater than the depth of the slot. The cover 12 bears on the bottom of the slot via the two end portions 12A2 and 12A3. It may be seen that the end portions each have a corner face 12A2' and 12A3' leaving a space with the bottom of the slot on the insert side.

The manufacture of an example of a part according to the invention with an insert thus comprises the following steps:

- a metal body 10, for example made of a titanium alloy, is prepared with at least one upper plane face;
- at least one open straight slot 10A is machined on an upper or lower face 10B. This operation is relatively simple as only the depth and width of the slot need to be considered;
- the insert 11 formed from an assembled bundle of coated straight fibres is placed in the slot; and
- the block-shaped cover 12 is put into place after having its temperature lowered sufficiently so that it contracts. One simple means is to bring it into contact with liquid nitrogen. The dimensions of the block-shaped cover and of the slot are determined so that the cover can be easily placed in the slot after having been cooled. Upon expanding, the cover then bears against the lateral walls, eliminating any clearance.

After the block-shaped cover has been put into place, the assembly is subjected to a vacuum. The vacuum is created and the temperature of the cover is raised so that, when the space surrounding the insert is under vacuum, the cover expands and forms a seal around the perimeter of the cover.

The top of the cover 12 projects from the surface of the metal body.

The container thus prepared is introduced into an enclosure for carrying out the hot isostatic pressing.

Heat and compression are applied in order to compact the container. When the insert is formed from a bundle of coated fibres, the treatment results in a volume reduction and a densification of the insert. The central portion of the cover descends into the slot as a piston. The transition zone formed by the corner faces 12A2' and 12A3' allows the cover to deform without the shear forces causing the cover to crack.

The blank obtained is ready to be machined.

After machining, the part shown in FIG. 2 is for example obtained, comprising the positioning of the corresponding number of inserts.

Figure 5:
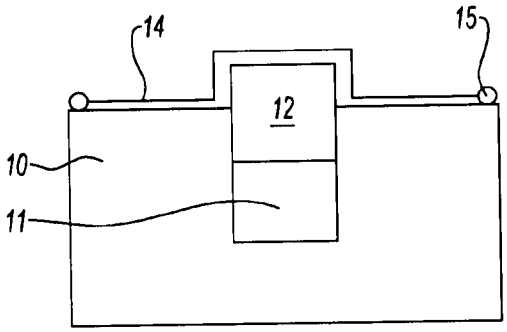
FIG. 5 shows in cross section an embodiment variant of the invention.

According to a variant (see FIG. 5), in addition a sheet 14 is placed on the block-shaped cover 12, this being welded to the periphery of the metal body with a bead 15 so as to improve the seal. The sheet, as may be seen in the figure, comprises a housing 14' for it to be fitted onto the cover, from which a part projects, corresponding substantially to the expected reduction in volume of the insert during the compaction operation.

An embodiment of the invention has been shown with the machining of a slot for housing the insert which is closed longitudinally. However, it would not be outside the scope of the invention to produce one or more longitudinally open slots.

Furthermore, the insert may have any suitable shape for the application of internally reinforcing a metal part. The shape may be oblong, in the form of a ring with two straight portions joined by rounded portions. The element covering the insert in the slot has the same shape as the insert if it has to be fitted over the insert and plug the slot.

The process of the invention thus makes it possible to produce any part of elongate shape incorporating in particular one or more straight inserts.

The invention claimed is;

1. A process for manufacturing a metal part having internal reinforcements formed from ceramic fibers, comprising:

- at least one housing for an insert is machined in a metal body having an upper face;
- at least one insert formed from metal-coated ceramic fibers is placed in the housing;
- the insert is covered with a cover;
- a vacuum is created in an interstitial space around the insert and the space is hermetically sealed;
- an assembly of the metal body with the cover is treated by hot isostatic pressure; and
- the treated assembly is machined to obtain the part,
- wherein the insert is straight, and the housing for the insert in the metal body forms a corresponding straight slot, and the cover is cooled before being placed in the housing, the cover being configured to allow it to be fitted onto the insert with a clearance in the housing after having been contracted by being cooled and to exert a tight fit by expansion in the slot so as to close off the space.

2. A process according to claim 1, in which the cover is cooled by a liquefied gas, or a liquid nitrogen.

3. A process according to claim 1, in which the slot includes a first housing portion for the insert and at least one second portion extending the first portion, the cover being block-shaped and including a central branch covering the insert and an extension of shape corresponding to the second portion of the slot.

4. A process according to claim 3, the cover being block-shaped and including a progressive deformation zone between the central branch and the extension.

5. A process according to claim 1, in which the insert has a polygonal, or rectangular, cross section, or an oval or circular cross section.

6. A process according to claim 1, the insert of which is formed from metal-coated fibers assembled into a bundle.

7. A process according to claim 1, the space of which is hermetically sealed by a weld bead.

8. A process according to claim 1, in which a sheet is placed on the cover that is block-shaped and welded onto the body.

9. A process according to claim 1, in which at least a second insert is placed in the metal body.

* * * * *